US006272932B1

(12) United States Patent
Nishida

(10) Patent No.: US 6,272,932 B1
(45) Date of Patent: Aug. 14, 2001

(54) METHOD AND APPARATUS FOR ADJUSTING CASTING SAND USING THE OPTIMUM COMPACTIBILITY

(75) Inventor: Tadashi Nishida, Toyokawa (JP)

(73) Assignee: Sintokogio, Ltd., Aichi Prefecture (JP)

( * ) Notice: Subject to any disclaimer, the term of this patent is extended or adjusted under 35 U.S.C. 154(b) by 0 days.

(21) Appl. No.: 08/676,058

(22) Filed: Jul. 5, 1996

(30) Foreign Application Priority Data

Jul. 7, 1995 (JP) ..... 7-196017

(51) Int. Cl.[7] ..... G01N 11/00
(52) U.S. Cl. ..... 73/823; 73/818
(58) Field of Search ..... 73/818, 819, 821, 73/823, 865.5

(56) References Cited

U.S. PATENT DOCUMENTS 3,638,478 * 2/1972 Dietert et al. ..... 73/823
4,550,768 * 11/1985 McMullen et al. ..... 73/866
4,616,508 * 10/1986 Jorn ..... 73/818
4,699,011 * 10/1987 Bradway et al. ..... 73/818

FOREIGN PATENT DOCUMENTS 63-34775 9/1988 (JP) ..... B22C/5/18
1-15825 3/1989 (JP) ..... G01N/33/24
5-71752 9/1993 (JP) ..... G01N/3/12

* cited by examiner

*Primary Examiner*—Max Noori
(74) *Attorney, Agent, or Firm*—Gray Cary Ware & Ware & Freidenrich LLP

(57) ABSTRACT

An adjusting method and apparatus is provided for optimizing the CB of casting sand relative to the deformation properties of a casting mold. The method consists of measuring compactibility of casting sand by compactibility measuring means 4 and a value of compressive deformation of a sample mold 10 corresponding to the compactibility by compressive deformation measuring means 5, repeating the measuring step at least three times, and operating the optimum compactibility, at which the value of compressive deformation of the sample mold 10 is the minimum, by operation means 7.

6 Claims, 2 Drawing Sheets

METHOD AND APPARATUS FOR ADJUSTING CASTING SAND USING THE OPTIMUM COMPACTIBILITY

BACKGROUND OF THE INVENTION

This invention relates to a method of adjusting casting sand, and more particularly to a method and apparatus for determining the optimum compactibility (hereinafter referred to as CB) of the casting sand, and for adjusting the casting sand accordingly.

It is well-known that CB is controlled to adjust casting sand in kneading batches (see, for example, Japanese Patent Publication No. 3-76710). In this method, the CB of casting sand is controlled by adding water, while amounts of additives, such as bentonite, new sand, and fine powder, are kept constant in a batch so as to achieve a given target value of the CB. However, the CB of casting sand, as a target value for the control, has been only empirically set, and there has been no method of determining its optimum CB.

On the one hand, there is a method of adjusting the amounts of additives, such as bentonite, new sand, and fine powder, to adjust casting sand on a long-term basis. In this method, the amounts of additives, such as bentonite, are adjusted by measuring the degree of ventilation, the resisting force, the percentage of active clay, and the percentage of total clay, on an hourly or a daily basis. The purpose of this is to keep constant the properties of the casting sand, such as the particle size distribution and percentage of clay thereof. This is because the casting sand is differently affected by heat when being circulated, including during kneading, molding, casting, demolding, and recovery, depending on the weights, shapes, and ratios of sand to metal, of the cast products, and because the casting sand is carried away with the product or through a dust collector.

However, there has been almost no such long-term adjusting method, wherein the deformation property of a casting mold has been considered. In other words, the deformity of a casting mold results from transportation thereof, casting of molten metal thereinto, or loading of weights thereon. Further, this deformity of the mold affects high-precision or thin-walled cast products, which are now strongly demanded in the industry. However, in a conventional long-term adjusting method for casting sand, these relationships relative to the deformities of a casting mold have not been considered, not to mention that there has been no idea to connect the long-term adjustment of the casting sand to the CB. Thus, heretofore there has been no attempt to optimize the target -value of the CB on a batch basis or long-term basis. By considering such present circumstances this invention was devised to provide a method for determining the optimum CB of casting sand, which is connected to the deformation properties of the casting mold in adjusting the casting sand.

SUMMARY OF THE INVENTION

To achieve the above-mentioned purpose the method of this invention for determining the optimum compactibility of casting sand comprises measuring compactibility of the casting sand by compactibility measuring means, and measuring a value of compressive deformation of a sample mold corresponding to the compactibility by compressive deformation measuring means, repeating the measuring step at least three times, and operating the optimum compactibility, at which a value of compressive deformation of the sample mold is the minimum, by operation means.

This invention can determine the optimum CB of casting sand, wherein a value of compressive deformation of an actual casting mold is the minimum, by using the above-mentioned means of resolving these matters.

This invention was based on the following observations. The inventor found that the value of compressive deformation could be associated with CB by selecting the deformation value as a casting-mold characteristic. That is, a case is estimated wherein the value of deformation of an actual casting mold is the minimum, by forming a sample casting mold, and by measuring the value of compressive deformation thereof. The representative characteristics of casting sand are then replaced by those of the sample mold, whose value of compressive deformation is the minimum. Conversely, it was deemed that a casting mold, whose value of deformation is the minimum, can be made by controlling the representative characteristics of the casting sand. The representative characteristics of the casting sand include a particle-size index, a percentage of total clay, or an ignition loss of the cumulatively kneaded sand. However, it was difficult to grasp relationships in a kneading batch between a compressive-deformation value and a particle-size index, or a total-clay percentage, or an ignition loss. Therefore, I found a method wherein the compressive-deformation value of casting sand was indirectly controlled by assuming the CB to be a representative characteristic, since the control of the CB in a kneading batch is comparatively easy.

Although it has been unclear what the relationship is between the compressive-deformation value of casting sand and the CB, the inventor found the relationships as in FIG. 1 after repeated experiments on this point. FIG. 1 shows the relationships between the CB percentages and values of distortion when a constant compressive load is applied to sample casting molds. In kneading recovered sand A and B and new sand, they have their respective different relationships between the CB percentages and compressive-deformation values, and the CB percentage, where the compressive-deformation value is the minimum, becomes smaller in sequence from the recovered sand A to B to new sand. Further, even if the kinds of sand differ, as for A, B, and the new one, the curves are always convex downward within a range of the CB percentages usually in use. Thus, to minimize the compressive-deformation value the CB may be controlled so as to minimize its compressive-deformation value. As stated above, this invention aims to find the relationship between the CB and distortion values when a constant compressive load is applied thereto, and to adjust the optimum casting sand by applying this relationship to the control of the CB.

PREFERRED EMBODIMENTS

Figure 1:
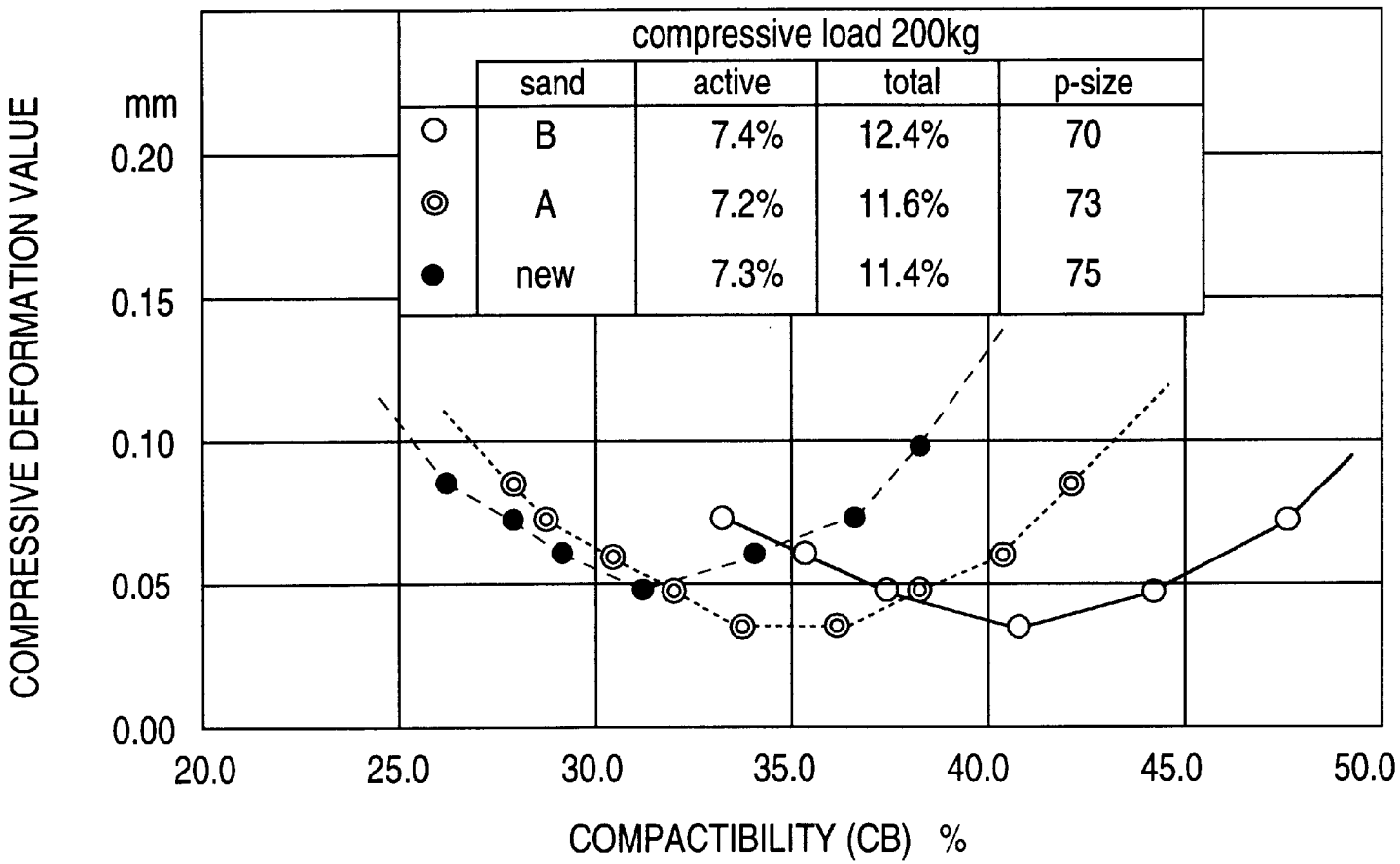
FIG. 1 shows graphs showing relationships between the compressive deformation of sample casting molds formed from various types of casting sand and the CB.
Figure 2:
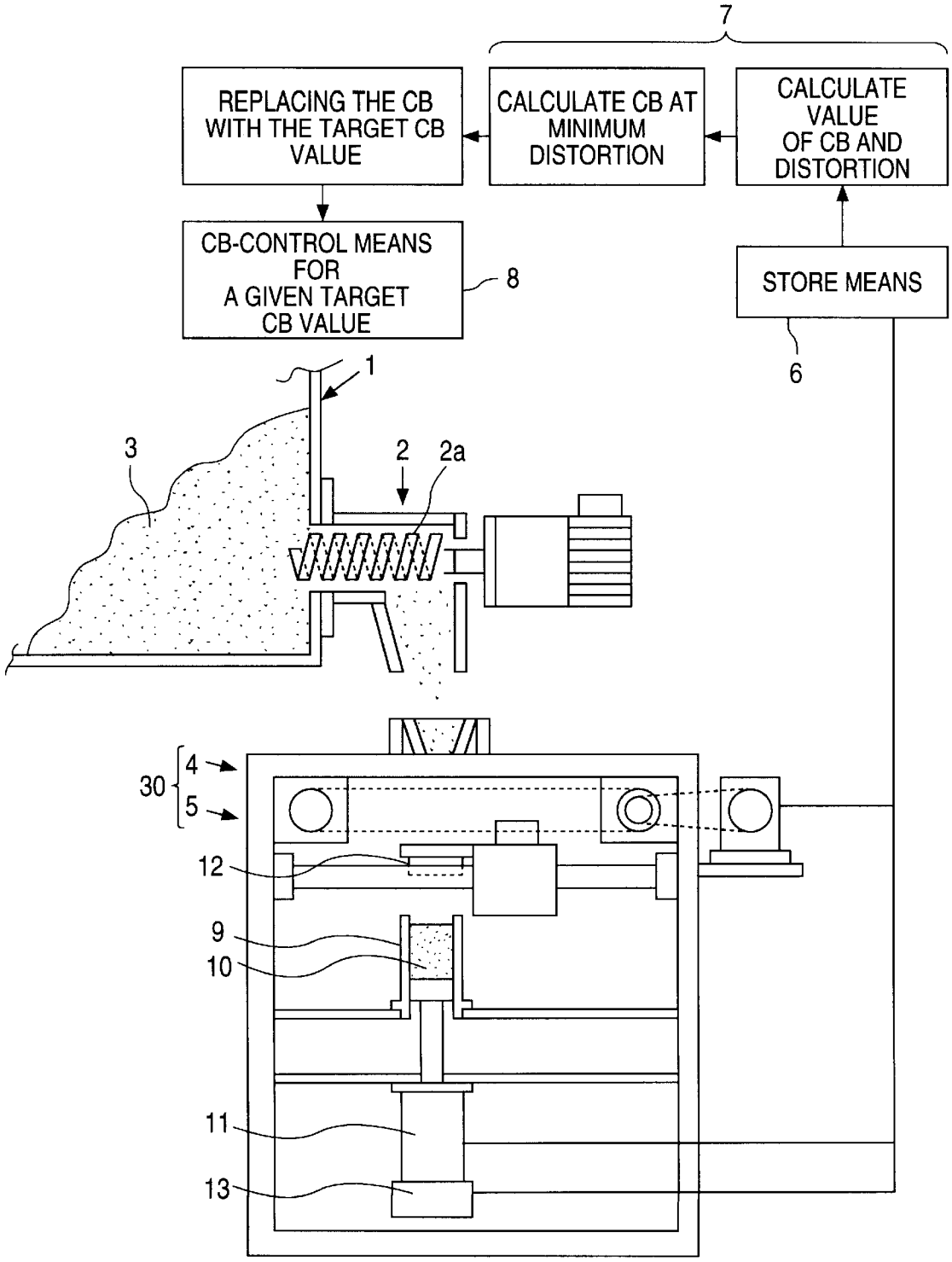
FIG. 2 is a schematic diagram of an embodiment of this invention.

An embodiment of this invention will now be explained in detail by reference to the drawings. FIG. 2 exemplifies a constitution for implementing this invention. Sampling means 2 is provided by a kneader 1. The sampling means 2 samples casting sand 3 being kneaded. Under the sampling means 2, measuring means 30 is provided for measuring the properties of the casting sand 3, which consists of CB-measuring means 4 for measuring the CB of the casting sand and compressive-deformation measuring means 5 for measuring the compressive-deformation value of a sample mold 10 formed from the casting sand 3. Both the CB-measuring means 4 and compressive-deformation measuring means 5 are electrically connected to store means 6. Operation means 7 is also electrically connected to the store means 6, which is electrically connected to CB-control means 8.

The details of each means will now be explained. The CB-measuring means 4 measures the rate of the fall of the casting sand 3 when a fixed quantity of the casting sand 3 is measured and put into a test cylinder 9, and then compressed. The value of the fall is actually measured by an encoder 13 mounted on a servomoter 11. The CB-measuring means 4 is well-known by, for example, Japanese Patent Publication No. 1-15825.

The compressive-deformation measuring means 5 for the sample mold operates as follows: for example, a cylindrical sample mold 10 (50 mm in diameter and 50 mm in height) is formed by compresssing a fixed amount of the casting sand 3, which has been measured and put into the test cylinder 9; the compressive-deformation value is measured while the test mold 10 is being compressed both from the upper and lower ends; actually, the load is measured as a resisting force by a load cell 12, and the test mold 10 is measured by the encoder 13, while the speed and torque are controlled by the servomotor 11. The compressive-deformation measuring means 5 consists of the load cell 12 mounted on a well-known apparatus, as shown in, for example, Japanese Utility Model Early-publication No. 5-71752.

A microcomputer is used as the store means 6 and the operation means 7. The CB control means 8 operates as follows: when the kneader 1 starts kneading the casting sand 3, the properties of the casting sand 3 are measured by an automatic measuring device; the resultant measurements are sent to the control means so as to calculate the quantity of water needed to be added to enable the casting sand 3 being kneaded to achieve the target CB value; the water is thus supplied from a water tank or a supply pipe. The CB control means 8 is well-known, for example, by Japanese Utility Model Publication No. 63-34775.

The operations of the apparatus constituted as described above will now be explained. The sampling means 2 disposed by the kneader 1 samples the casting sand 3 while the sand 3 is being loosened by a spring 2*a*. The casting sand 3 is put into the CB measuring means 4 to measure the CB. The casting sand 3 of the same CB is put into the compressive-deformation-value measuring means 5 to form the sample mold 10 so as to measure the resisting force and distortion. Next, the data on the values of the CB, resisting force, and distortion, are read out from the store means 6 to calculate the value of the CB and distortion under a constant compressive load, by the operation means 7. The value of the CB, at which value the amount of distortion under the constant compressive load is the minimum, is calculated by the operation means 7 to obtain a relationship between the CB and distortion so as to obtain the CB at which the distortion is the minimum. For this calculation, for example, the least square method can be used. The target CB value is then obtained by replacing the CB at which the distortion is the minimum under the constant compressive load with the target CB value. By using the obtained target CB value, the quantity of water to be added to the casting sand being kneaded is controlled by the CB control means 8 so as to achieve a mold characteristic, which enables the compressive deformation value of the casting sand 3 to be the minimum. As stated above, this invention can provide a method of determining the optimum CB, enabling the compressive deformation value to be the minimum, by indirectly monitoring the compressive deformation value, which is one of the casting mold's characteristics.

In this embodiment, a method incorporated in a sand adjusting line has been disclosed. However, the apparatus of this invention may also be disposed in a place remote from the sand adjusting line, for example, in a laboratory, and there the optimum CB value of the casting sand can be determined so as to operate the CB control means 8 by replacing the target CB value with that value. Further, the means for determining the target CB value in the sand adjusting line can be disposed in any location, for example, near the mold-forming means, instead of a position just under the kneader.

For the actual control of the CB, the target CB may be set by considering variations of the casting sand being carried, based on the optimum CB. Although the compressive-deformation value was obtained from the values of the resisting force and distortion of the sample mold 10 formed from the casting sand, the CB of which mold was measured, this method is not limited thereto. Although a cylindrical sample casting mold was used to measure the compressive-deformation value, any shape or size mold may also be used. In short, any type of casting mold may be used so long as the CB of the casting mold and the compressive deformation value corresponding to the CB can be measured.

As can be seen from the above-mentioned descriptions, the method of this invention for adjusting casting sand enables the acquisition of the optimum CB or the casting sand, with which the minimum value of the compressive deformation of an actual mold is obtained, to be adjusted. Thus, this invention has significant effects in the industry in that the deformation of a casting mold during transportation or the expansion of a casting mold during casting can be kept to the minimum.

What is claimed is:

1. A method of determining optimum compactibility of casting sand, comprising the steps of:

(a) measuring compactibility of a sample of the casting sand and a value of compressive deformation of the sample thereby generating signals indicative of the compactibility and said value of the compressive deformation, (b) repeating the measuring step at least three times, each time on a different sample of the casting sand, and processing the resulting signals to determine an optimum compactibility of the casting sand by determining the compactibility at which the value of the compressive deformation of the casting sand is at a minimum.

2. The method of claim 1, wherein step (a) comprises:

measuring the compactibility of the sample, and measuring values of a resisting force and distortion of a mold of the sample.

3. The method of claim 1, wherein the step of determining the optimum compactibiity of the casting sand comprises:

storing measurements of compactibility, a resisting force, and distortion, and calculating a compactibility value, at which the distortion value under a constant compressive load is at a minimum, by processing signals indicative of said measurements.

4. An apparatus for determining optimum compactibility of casting sands comprising means for measuring compactibility of each of a number of samples of the casting sand and generating signals indicative of each said compactibility, means for measuring a value of compressive deformation of each of the samples and generating signals indicative of each said value of the compressive deformation, and operation means for receiving and processing the signals to determine an optimum compactibility of the casting sand at which the value of the compressive deformation of the casting sand is at a minimum.

5. A method of adjusting casting sand, wherein casting sand in a kneading means is sampled by a sampling means mounted on the kneading means, and wherein the casting sand is adjusted such that compactibility values of the sampled casting sand are measured while water is added to the sand, so as to obtain a target compactibility value, the method comprising the steps of:

measuring the compactibility of each of a set of samples of the casting sand being kneaded in the kneading means thereby determining measured compactibilities, and measuring values of a resisting force and distortion of a sample mold formed from each of the samples of the casting sand said each of the samples having one of the measured compactibilities, processing signals indicative of the measured compactibilities and the measured values in an operation means to determine an optimum compactibility, at which a value of compressive deformation of the sand is at a minimum, and replacing the target compatibility value to more nearly match the optimum compactibility.

6. The method of claim 1, also including the step of:

(c) controlling the compactibility of the casting sand to match said optimum compactibility.

* * * * *